United States Patent [19]

Magnusson

[11] 4,227,619

[45] Oct. 14, 1980

[54] BOTTLE CAP WITH RING SHAPED TEARING ELEMENT

[75] Inventor: Sven-Ake Magnusson, Kungälv, Sweden

[73] Assignee: Wicanders GmbH, Düsseldorf, Fed. Rep. of Germany

[21] Appl. No.: 923,088

[22] Filed: Jul. 10, 1978

[30] Foreign Application Priority Data

Feb. 24, 1978 [DE] Fed. Rep. of Germany ..... 7802184

[51] Int. Cl.[3] ..... B65D 41/32

[52] U.S. Cl. ..... 215/255

[58] Field of Search ..... 215/254, 255, 256; 220/270

[56] References Cited

U.S. PATENT DOCUMENTS

| | | | |
|---|---|---|---|
| Re. 28,862 | 6/1976 | Siemonsen | 215/255 |
| 1,052,382 | 2/1913 | Schmitt | 215/254 |
| 1,058,640 | 4/1913 | Stenius | 215/254 |
| 1,612,927 | 1/1927 | Kuhne | 215/255 |
| 2,068,444 | 1/1937 | Breckenridge | 215/254 |
| 2,571,898 | 10/1951 | Kondakow | 215/255 |
| 3,320,767 | 5/1967 | Whalen | 220/270 X |
| 3,370,169 | 2/1968 | Bozek | 220/270 |
| 3,380,609 | 4/1968 | Potts | 215/254 |
| 3,785,519 | 1/1974 | Huh | 215/254 |
| 3,902,621 | 9/1975 | Hidding | 215/254 |

FOREIGN PATENT DOCUMENTS

| | | | |
|---|---|---|---|
| 810931 | 6/1951 | Fed. Rep. of Germany | 215/255 |
| 930906 | 2/1948 | France | 215/255 |
| 328614 | 8/1935 | Italy | 215/254 |
| 24174 | of 1910 | United Kingdom | 215/255 |
| 773334 | 4/1957 | United Kingdom | 215/256 |
| 1260820 | 1/1972 | United Kingdom | 215/255 |

*Primary Examiner*—George T. Hall

*Attorney, Agent, or Firm*—Brumbaugh, Graves, Donohue & Raymond

[57] ABSTRACT

A tear tab closure for containers comprises a cap having a top, a downwardly depending skirt, a tear tab projecting from the skirt and terminating in a finger ring. The tear tab is relatively short and the finger ring is secured thereto by any suitable mechanical or adhesive fastening means. The finger ring is of large enough inside diameter to facilitate capture of the finger ring by a finger of the user and it may be disposed to lie at the side of the container or it may be large enough in diameter to encircle the container in close proximity thereto.

16 Claims, 6 Drawing Figures

BOTTLE CAP WITH RING SHAPED TEARING ELEMENT

BACKGROUND OF THE INVENTION

The present invention relates to closures for containers and more particularly to tear tab closures for bottles and the like for containing fluid under pressure.

For a tear tab closure to be practical, it is essential that the tear tab be capable of being gripped easily but securely by the finger of the user and manipulated to open the closure effectively under unfavorable conditions with minimum risk of injury to the user. In the past, attempts have been made to achieve these objectives by using a relatively long tear tab provided with parallel embossings in the form of pyramids, ridges, or the like disposed perpendicularly to the tearing direction, as shown in prior U.S. Pat. Nos. 1,052,382 to Schmitt and 2,068,444 to Breckenridge.

It is often difficult for such tabs to be gripped and manipulated properly even by a person of normal motor ability and muscle strength. Also, under unfavorable conditions, as where the finger of the user or the tear tab is wet, there is risk of injury in the event the fingers of the user slip. Moreover, it is possible for the tear strip to be torn open accidentally if the tab projects from the container and catches against the edge of a table or the like.

It has also been proposed to use caps having a tear tab terminating in an integral circular ring adapted to receive a finger of the user, as illustrated in prior U.S. Pat. Nos. 3,380,609 to Potts, 3,785,519 to Huh, and 3,974,931 to Moller. These caps, however, are very difficult to make and therefore very expensive. Moreover, both they and caps having long tear tabs require complicated machinery in their manufacture.

SUMMARY OF THE INVENTION

It is an object of the invention, accordingly, to provide a new and useful tear tab closure for bottles and the like which is essentially free from the above noted deficiencies of the prior art.

These and other objects of the invention are achieved by providing a tear tab closure having a tear tab with a relatively short free end to which is secured a finger ring of a size to accommodate the finger of a user comfortably and made of a material thicker than the tear tab so as to possess sufficient tensile strength and to minimize the likelihood of injury to the user. The finger ring may normally lie at one side of the container, depending downwardly from the tear strip end to which it is secured. Alternatively, it may be large enough in diameter so that it can be disposed normally to surround the neck of the container on which it is mounted in relatively close proximity thereto.

Because of the reduced length of the tear tab free end, a substantial saving of material can be achieved in the manufacture of tear tab closures according to the invention, as compared with tear tab closures having an integral finger ring. Also, since the seal can be formed in the cap before the finger ring is attached to the tear tab, the undesirable accumulation of sealing material at the root of the tear tab which sometimes occurs with closures having integral finger rings because of the lever action of the tab and ring is eliminated.

The invention may be better understood from the following detailed description, taken in conjunction with the accompanying drawings, in which.

Figure 3:
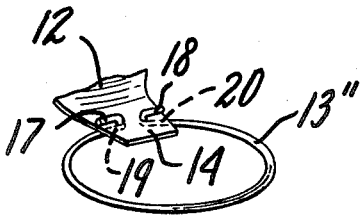
Figure 3A:
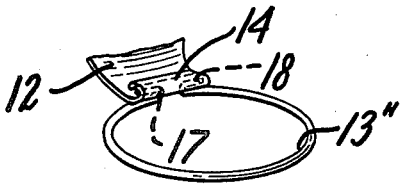
Figure 4:
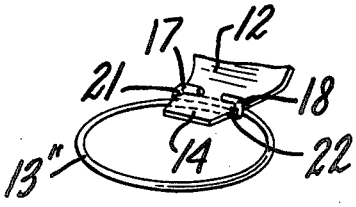
Figure 5:
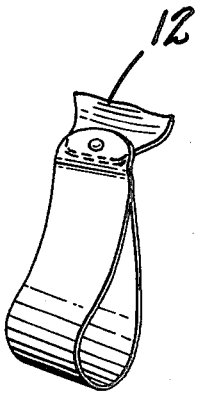

FIGS. 3, 3*a* and 4 illustrate different ways of securing a finger ring to a tear tab closure according to the invention; and FIG. 5 is a view in perspective of a further embodiment of the invention.

Figure 1:
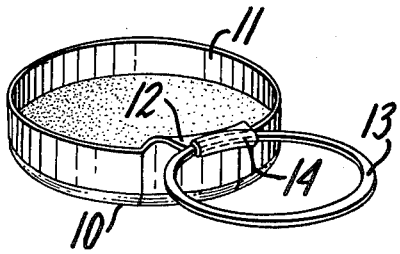
FIG. 1 is a view in perspective of an inverted tear tab closure constructed according to the invention before mounting on a container.

The closure shown in FIG. 1 is made of thin, light metal and comprises a disc shaped top wall 10, a substantially cylindrical skirt 11 which surrounds the top wall, and a tear tab 12 projecting from the skirt 11. The free end of the tear tab 12 need only be long enough to enable a finger ring to be fastened thereto, and preferably it tapers away from the skirt 11 from its base adjoining the skirt to its free end. To facilitate tearing the cap open, a finger ring 13 is attached to the free end 14 of the tear tab 12, and score lines 15 and 16 (FIG. 2) extend from locations on each side of and immediately adjoining the root of the tear tab 12, across the skirt 11, and over the top wall 10.

The score lines are not part of the invention and they may follow any arbitrary route which may be symmetrical or asymmetrical, they may contain mutually converging or mutually diverging sections, and they may be of different lengths. Also, the cap blank may be provided with a sealing insert which may be suitably bonded to the undersurface of the cap by means of an adhesive lacquer or the like. The sealing insert may cover the top section completely, but if the score lines substantially follow the bead which surrounds the aperture of the bottle to be sealed with the cap, the insert may preferably consist of a ring seal.

The finger ring should preferably be made of plastic, in particular reinforced plastic, and it should be large enough to accommodate the finger of the user comfortably. To this end, its inside diameter should be greater than the width of the tear tab 12, and should preferably exceed approximately 12 mm. In a practical closure, the inside diameter may be approximately 16–18 mm.

The ring thickness need only be great enough to avoid the risk of breakage at the time of pulling, and also the risk of injury, or at least of discomfort, to the user when the ring is pulled for the purpose of tearing the cap. Thus, typically the thickness of the ring may be approximately 0.6–1.0 mm and its width in the radial direction may be approximately 1.2–1.8 mm, but these values are intended only to give guidance as to preferred dimensions, and greater or smaller dimensions may be used.

In FIG. 1, the ring 13 is attached to the free end of the tear tab 12 by curling, but it may equally well be attached by riveting, gluing, or any other well-known method, or by combinations of such methods. Since the tab 12 serves only as anchorage for the ring 13, it should preferably be much shorter than a conventional tear tab, resulting in a substantial saving of material in the manufacture of the cap. Furthermore, the ring 13 should be attached to the free end 14 of the tab so as to form a substantially linear extension of the latter, and normally it lies at one side of the closure as shown.

Figure 2:
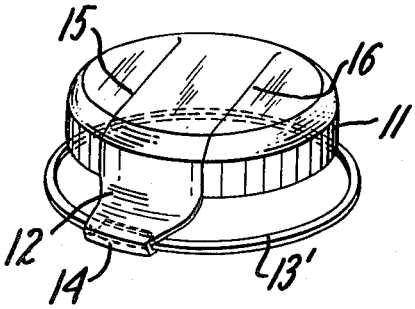
FIG. 2 is a view in perspective of another embodiment of the invention shown right side up.

If desired, the finger ring may be made large enough in diameter to be swung over the top of the closure so as to encircle the top of the container in relatively close proximity thereto, as shown in FIG. 2. In use, the ring 13' can be twisted from its position under the skirt 11, around the axis of its hinged anchorage in the free end 14 of the tear tab 12, to a position which allows the ring to be gripped by the user and pulled for the purpose of tearing the cap.

It is important that the rings 13 and 13' be located some distance away from the skirt 11, as shown in FIGS. 1 and 2, if difficulties are to be avoided in clamping the skirt against the bead at the bottle opening. Once the capping process has been completed, the orientation of the ring in relation to the skirt can, of course, be altered, if desired. For example, the tab 12 can be bent in such a way that the ring 13 is brought downwards and inwards towards the neck of the bottle, and the ring 13' can be brought upwards to surround the skirt section 11. Also, the side of the ring which is opposite the tab may be detachably fastened in any suitable way.

In the form of the invention shown in FIGS. 3 and 3*a*, the finger ring 13" may be made of a material such as aluminum wire, for example, shaped to have adjacent, upwardly extending ends 17 and 18 separated by a small gap. The ends 17 and 18 are adapted to be inserted through spaced holes or slits 19 and 20 formed in the tear tab 12 and bent parallel to the ring 13" so as to secure the ring to the tab.

The attachment of the ring 13" to the tab 12 can be further strengthened by curling the end 14 of the tab 12 over the bent back wire ends 17 and 18 as shown in FIG. 3*a*. In addition, the attachment may be made even more secure by pressing and/or stamping the curled tab end 14 over the ring ends.

The ends of the ring 13" in FIGS. 3 and 3*a*, for instance, can be attached to the tab in such a way that they overlap. Also, the ends of the ring can be joined to the tab in a hinge-like fashion by inserting the ends 17, 18 of the wire into two holes disposed at a distance from each other across the width of the tab, or by some similar arrangement. Of course, the ring 13" can also be inserted into the tab 12 from the opposite side and the curling in FIGS. 1, 2 and 3*a* can be done towards the underside of the tab.

If desired, the ends 17, 18 of the finger ring 13" may overlap each other in scissorlike fashion and be bent inwardly over the edges of the tab 12 in such a way that they exert a certain amount of spring pressure on the tab edges, as shown in FIG. 4, suitable lateral notches 21 and 22 preferably being provided to hold the ends of the ring in place. For greater strength, the ends 17, 18 of the wire ring 13" may be effectively secured to the tab 12 by any of the methods described above, such as pressing and/or stamping and subsequent curling of the end 14 of the tab over the wire ends.

The invention thus provides a simple and highly effective tear tab closure for containers such as bottles and the like. By providing a tear tab terminating in a finger ring of a diameter to accommodate the finger of a user comfortably and made in a shape and of a material free from sharp edges, capture of the ring by the finger of a user may be effected with a minimum of effort and risk of injury. Also, since the finger ring need not be secured to the closure until after the seal has been formed, the usual accumulation of sealing material at the root of the tab that often occurs in the manufacture of tear tab closures having conventional integral, outwardly, projecting, long tear tabs may be totally eliminated.

The specific embodiments described herein are intended to be merely illustrative and modifications in form and detail are, of course, possible. Thus, the finger ring may be made of other materials than plastic and it may be attached to the tab in a variety of different ways. For example, instead of curling the tab material around the ring, the ring may be fastened to the tab by riveting or gluing. Also, by the selection of suitable materials, it may, of course, be possible to melt the tab material and the ring material together. Furthermore, the tab and/or the ring may be provided with one or more ridges or similar protuberances, and the ring affixed by deformation of these ridges by cold-rolling or the like. In addition, the joint between ring and tab may be further strengthened by spot welding, and it is also possible to affix the ring by applying suitable corrugations to the tab.

Another way of securing a ring to the short tab on a cap according to the invention is to bend the tab so that it extends substantially parallel to and away from the skirt. A circular band with overlapping ends is then positioned substantially coaxially with the cap so that the ends overlie the tab and the band is rolled into a ring enclosing the tab and securing the ring to the latter.

It will be understood, of course, that the finger grip may comprise a loop or ring shaped flexible ribbon of plastic or similar material as shown in FIG. 5, which can be attached to the tab in any suitable manner, as by gluing, riveting, or melting together. Also, the finger grip may have a shape other than the practically circular shape shown in the drawings. For example, it may be pear shaped. The invention is intended to encompass all such modifications as fall within the scope of the following claims.

I claim:

1. A tear tab closure for containers such as bottles and the like comprising a cap having a top wall, a downwardly depending skirt and score lines in the skirt and top wall defining a tear strip adapted to be torn out to open the closure, in which the improvement comprises a relatively short extension on said skirt projecting generally radially away from the bottom of the skirt and defining a tear tab at one end of said tear strip, and a finger ring formed as a separate piece secured to the free end of said tear tab in nearby relation to the bottom of said skirt to facilitate pulling the tab to tear open the closure, said tab being fastened only to the skirt and being of a length to serve only as an anchorage for said finger ring and said finger ring having an inner radius large enough to accommodate a finger of a user to capture the ring securely with his finger with minimum effort and risk of injury.

2. A tear tab closure as defined in claim 1 in which the finger ring is cylindrical in cross section and the tear tab is tapered so that its width decreases outwardly towards its free end.

3. A tear tab closure as defined in claim 2 in which the free end of the tear tab is curled around a portion of the finger ring to secure the two together.

4. A tear tab closure as defined in claim 2 in which the finger ring has opposed ends separated by a gap and the opposed ring ends extend through openings in the rear tab and are bent so as to secure the ring to the tear tab.

5. A tear tab closure as defined in claim 4 in which the free end of the tear tab is wrapped around the bent ring ends to secure the same.

6. A tear tab closure as defined in claim 2 in which the finger ring has opposed ends separated by a gap, each ring end is bent back parallel to its adjacent ring portion, the bent back ring ends are overlapped to define a slot extending radially of said ring, and the free end of the tear tab is disposed in said slot.

7. A tear tab closure as defined in claim 6 together with means retaining the ring ends securely on the tear tab.

8. A tear tab closure as defined in claim 1 in which the finger ring is made of plastic material.

9. A tear tab closure as defined in claim 8 in which the finger ring is made of reinforced plastic material.

10. A tear tab closure as defined in claim 1 in which the finger ring is made of aluminum wire.

11. A tear tab closure as defined in claim 1 in which the inside diameter of the finger ring is at least approximately 12 mm.

12. A tear tab closure as defined in claim 11 in which the inside diameter of the finger ring is about 16–18 mm.

13. A tear tab closure as defined in claim 1 in which the thickness of the ring is in the range of 0.6–1.0 mm.

14. A tear tab closure as defined in claim 13 in which the radial width of the ring is in the range of 1.2–1.8 mm.

15. A tear tab closure as defined in claim 1 in which the finger ring has an inside diameter slightly larger than the outside diameter of the skirt.

16. A tear tab closure as defined in claim 1 in which the finger ring comprises a looped flexible ribbon.

* * * * *

UNITED STATES PATENT AND TRADEMARK OFFICE

CERTIFICATE OF CORRECTION

PATENT NO. : 4,227,619
DATED : October 14, 1980
INVENTOR(S) : Sven-Ake Magnusson It is certified that error appears in the above—identified patent and that said Letters Patent is hereby corrected as shown below:

First Page, Item [30], "Feb. 24, 1978" should be --Feb.27, 1978-- and "Fed. Rep. of Germany" should be --Sweden--;

Col. 3, lines 66-67, "outwardly, projecting" should read

--outwardly projecting--;

Col. 4, line 62, "rear" should read --tear--.

Signed and Sealed this

*Twenty-seventh* Day of *January 1981*

[SEAL]

*Attest:*

RENE D. TEGTMEYER

*Attesting Officer*

*Acting Commissioner of Patents and Trademarks*